US006389848B1

(12) United States Patent
Kyoutani

(10) Patent No.: US 6,389,848 B1
(45) Date of Patent: May 21, 2002

(54) COMPOUND NEEDLE

(75) Inventor: Minoru Kyoutani, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 09/926,467

(22) PCT Filed: May 15, 2000

(86) PCT No.: PCT/JP00/03127

§ 371 Date: Nov. 7, 2001

§ 102(e) Date: Nov. 7, 2001

(87) PCT Pub. No.: WO00/71796

PCT Pub. Date: Nov. 30, 2000

(30) Foreign Application Priority Data

May 19, 1999 (JP) ..... 11-139089

(51) Int. Cl.[7] ..... D04B 35/06
(52) U.S. Cl. ..... 66/120
(58) Field of Search ..... 66/116, 120, 123, 66/121

(56) References Cited

U.S. PATENT DOCUMENTS 1,364,088 A * 1/1921 Fenn ..... 66/120
1,461,007 A * 7/1923 Taft ..... 66/120
3,229,485 A * 1/1966 Peschel et al. ..... 66/120
4,043,153 A * 8/1977 Lindner et al. ..... 66/120
4,434,627 A * 3/1984 Pfrommer ..... 66/120
5,275,023 A * 1/1994 Schindler ..... 66/120

FOREIGN PATENT DOCUMENTS

JP 48-42161 A 4/1978
JP 1-154459 A 11/1989
JP 7-197359 A 8/1995

* cited by examiner

*Primary Examiner*—Danny Worrell
(74) *Attorney, Agent, or Firm*—Arent Fox Kintner Plotkin & Kahn, PLLC

(57) ABSTRACT

A compound needle comprising a needle body having a hook-shaped hook at a front end thereof and a slider which is supported on the needle body to move relative thereto in a longitudinal direction of the needle body to the hook-shaped hook so as to open and close the hook-shaped hook, so as to capture a knitting yarn and escape a knitting stitch, wherein a tongue provided at a front end portion of the slider is provided, at a front end thereof, with a drop-stitch-preventing shoulder to prevent a stitch held on the tongue of the slider from slipping off the tongue during a knitting operation, and also the hook-shaped hook is provided, on an outer edge thereof extending from a front end of a lip portion thereof toward a top thereof, with a stitch escape surface, such that when the hook-shaped hook is closed by the tongue, the drop-stitch-preventing shoulder is hidden by the stitch escape surface to facilitate a knock-over of the stitch.

4 Claims, 3 Drawing Sheets

COMPOUND NEEDLE

TECHNICAL FIELD

The present invention relates to a compound needle having a slider for use in knitting a knitting fabric.

BACKGROUND ART

In general, when a double stitch or a like stitch in which an increased number of loops are formed for each single stitch is formed by use of a compound needle to knit a knitting fabric, the loops are held on a slider tongue of the compound needle repeatedly several times, and there may be cases where the loops sometimes slip off the slider tongue to cause an imperfect knitting fabric. Any slippage of the loops from the end of the slider tongue into the hook before they are knocked over presents problems for knitting stitches, not peculiar to the double stitch.

There was proposed a compound needle wherein the slider tongue is provided, at a topside thereof at the end, with a small projection so that the loops held on the tongue can be caught by the small projection to provide a hard slippage of the loops (Japanese Patent Publication No. Hei 1(1989)-54459). The small projection provides the advantageous effect of holding the loops on the slider tongue reliably, while on the other hand, it provides the disadvantage of proving a hard release of the loops from the slider tongue to hinder the loops from being knocked over.

DISCLOSURE OF THE INVENTION

The present invention provides a compound needle comprising a needle body having a hook-shaped hook at a front end thereof and a slider which is supported on the needle body to move relative thereto in a longitudinal direction of the needle body to the hook-shaped hook so as to open and close the hook-shaped hook, so as to capture a knitting yarn and escape a knitting stitch, wherein a tongue provided at a front end portion of the slider is provided, at a front end thereof, with a drop-stitch-preventing shoulder to prevent a stitch held on the tongue of the slider from slipping off the tongue during a knitting operation, and also the hook-shaped hook is provided, on an outer edge thereof extending from a front end of a lip portion thereof toward a top thereof, with a stitch escape surface, such that when the hook-shaped hook is closed by the tongue, the drop-stitch-preventing shoulder is hidden by the stitch escape surface to facilitate a knock-over of the stitch.

It is preferable that the drop-stitch-preventing shoulder has an inclined loop holding surface, and the stitch escape surface provided on the hook has an angle of inclination smaller than that of the inclined loop holding surface.

It is preferable that when the hook-shaped hook is closed by the tongue of the slider, a part of the stitch escape surface at the front end of the lip portion of the hook is positioned at a lower level than an upper edge of the drop-stitch-preventing shoulder at the front end of the tongue of the slider with respect to a height of the hook-shaped hook between a bottom of the needle body of the hook-shaped hook and the front end of the lip portion of the hook, so that the part of the stitch escape surface is hidden by the tongue of the slider.

Further, it is preferable that the hook-shaped hook is so curved that when the hook-shaped hook is closed by the tongue of the slider, the stitch escape surface at a top of bend of the hook-shaped hook is positioned at a level at least equal to or higher than an upper edge of the drop-stitch-preventing shoulder at the front end of the tongue of the slider with respect to a height of the hook-shaped hook between a bottom of the needle body of the hook-shaped hook and the top of bend of the hook-shaped hook.

According to the present invention, the drop-stitch-preventing shoulder provided at the tongue of the slider prevents the loops held on the tongue from accidentally slipping off the tongue before the loops are knocked over. Then, when the hook-shaped hook is closed by the tongue to knock over the loops, the drop-stitch-preventing shoulder is hidden by the stitch escape surface provided on the outer edge of the hook extending from the end of the lip portion of the hook-shaped hook toward the top thereof, so that the loops are allowed to go beyond the shoulder so as to be knocked over.

Although the drop-stitch-preventing shoulder has an inclined loop holding surface to prevent the loops from slipping off the tongue, since the stitch escape surface provided on the hook is formed at an angle of inclination smaller than that of the inclined loop holding surface, the loops retained on the tongue of the slider are smoothly led to the stitch escape surface and thus are allowed to go beyond the inclined loop holding surface of the drop-stitch-preventing shoulder so as to be knocked over.

Also, since the compound needle of the present invention is so formed that when the hook-shaped hook is closed by the tongue of the slider, the front end of the lip portion of the hook is positioned at a lower level than the upper edge of the tongue of the slider, the front end of the lip portion of the hook is smoothly led into the loops.

Further, since the hook-shaped hook is so curved that the top of bend of the hook-shaped hook is positioned at a level equal to or higher than the upper edge of the drop-stitch-preventing shoulder, the loops are raised up over the drop-stitch-preventing shoulder by the top of bend of the hook-shaped hook, so that the loops can smoothly be shifted from the tongues of the slider.

BRIEF DESCRIPTION OF THE INVENTION

BEST MODE FOR CARRYING OUT THE INVENTION

Figure 1:
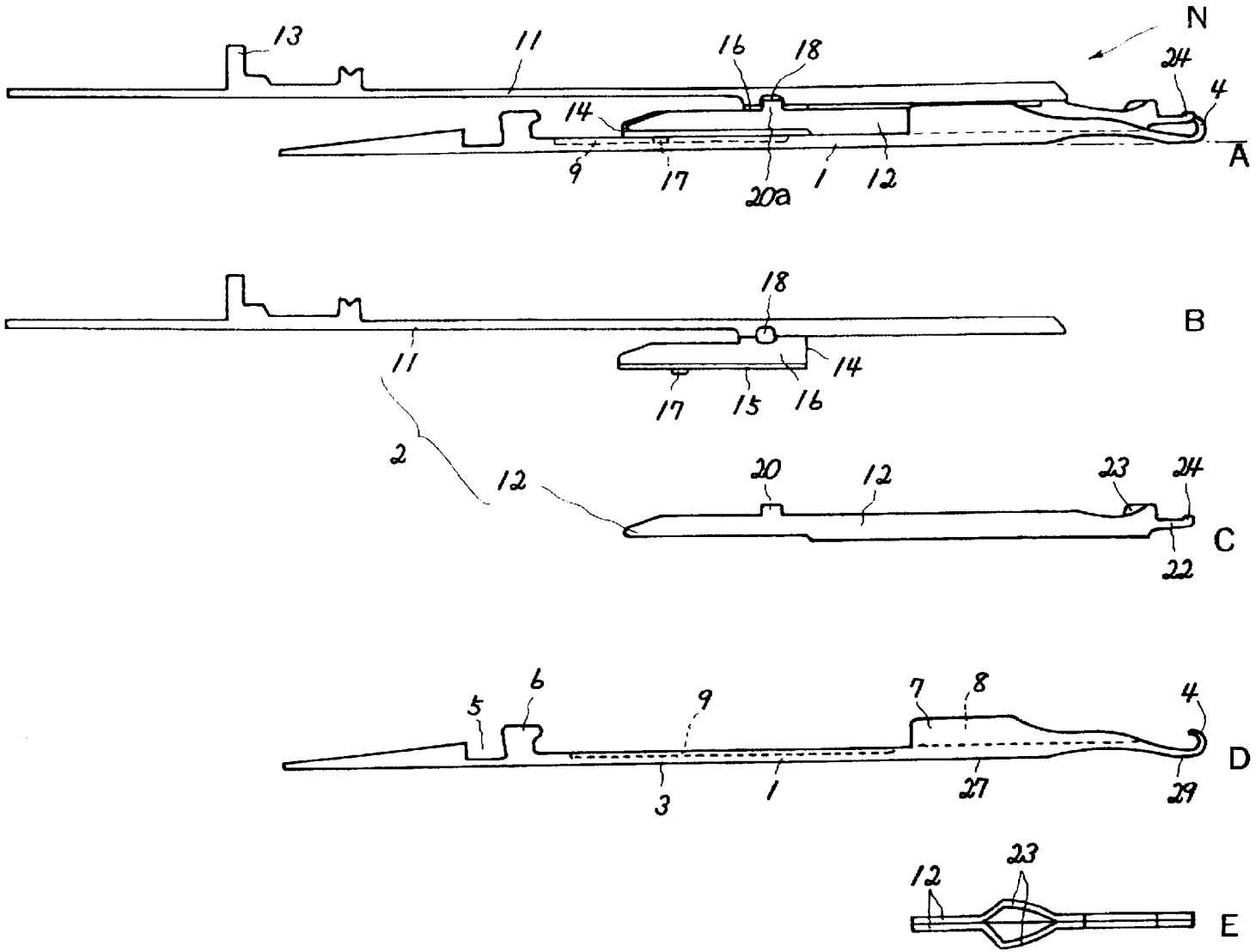
FIG. 1 illustrates an example of a compound needle of the present invention, A is a side view of the entirety of the compound needle, B is a side view of a slider jack, C is a side view of an elastic plate, D is a side view of a needle body, and E is an enlarged plan view of a slider tongue portion.

Certain preferred embodiments of a compound needle 1 of the present invention will be described below with reference to the accompanying drawings.

A compound needle N of an embodiment of the invention comprises a needle body 1 and a slider 2 to be slidbly engaged in the needle body 1. The needle body 1 is formed by punching out a plate member. The needle body 1 includes a shank 3 having a hook-shaped hook 4 at a front end thereof and a needle jack (not shown) engaging recess 5 and a slider stop 6 at a rear end thereof. It also includes sliding grooves 8, 9 for the slider 2 to be slidably fitted in, which are formed at an upper edge of a plate-like portion 7 in the vicinity of a head thereof and at an upper edge of the rod-like shank 3, respectively. The hook-like hook 4 can be formed into a specified shape not only by a press working but also by a bending process.

The slider 2 comprises a shank 11 and elastic plate members 12 fixed thereto. The shank 11 is provided, at an upper edge thereof at the rear end portion, with a slider butt 13, and is provided, at a lower edge thereof at the nearly forward portion, with a plate member supporting arm 14 branched out therefrom. The plate member supporting arm 14 has a thin-wall portion 16 formed in its whole area, except a lower edge portion 15, and a small projection 17 projected downward from the lower edge portion 15 to be fitted in the sliding groove 9. It also has a bored portion 18 formed between the thin-wall portion 16 and the shank 11.

A pair of symmetrical elastic plate members 12 are combined into a two-ply form having thickness equal to depth of the thin-wall portion 16 of the plate member supporting arm 14 of the shank 11. Each elastic plate member is provided, at an upper edge thereof, with a butt-like projection 20 and is provided, at a front end thereof, with a slider tongue 22. The slider tongue 22 is provided, at a base portion thereof, with a loop stopper 23 comprising a partly outward-spread snippet. The slider tongue 22 is provided, at an upper edge thereof at the front end, with an upwardly-crooked/projected drop-stitch-preventing shoulder 24.

In the combined state, the elastic plate members 12 are brought into engagement with the thin-wall portion 16 of the plate member supporting arm 14 of the shank 11 at the rear end thereof. Then, after putting into engagement in the bored portion 18 of the shank 11, the projection 20 is caulked from both sides thereof, so that the shank 11 and the two elastic plate members 12, 12 are formed as a unit to thereby produce the slider 2. One of the two elastic plate members 12 is provided, at a rear end portion thereof, with a gently outwardly crooked/projected portion to press the needle against a wall of the groove, so as to prevent rash action of the needle.

Figure 2:
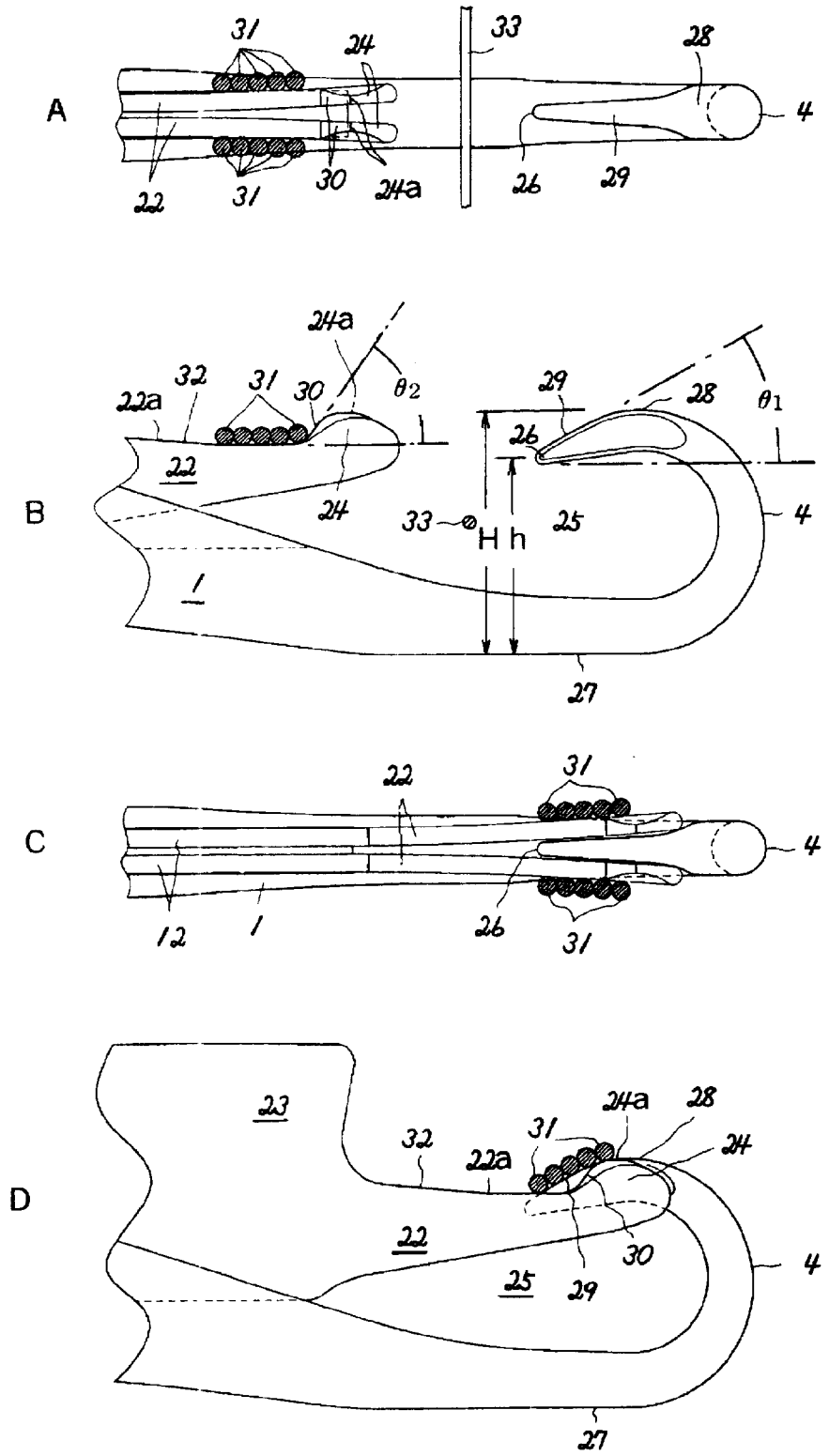
FIG. 2 illustrates a head of the compound needle, A is a plan view of a hook-shaped hook 4 with its eye open, B is a side view of the same, C is a plan view of the hook-shaped hook 4 with its eye closed, and D is a side view of the same.

The slider 2 is integrally combined with the needle body 1 by the small projection 17 of the plate member supporting arm 14 being slidably engaged into the sliding groove 9 of the needle body 1 and by the shank 11 being slidably engaged into the sliding groove 8 of the plate-like portion 7 of the needle body 1. The sliding movement of the slider 2 permits the slider tongues 22 to be advanced with respect to the hook-shaped hook 4 so as to hold the hook-shaped hook 4 in sandwich relation between the slider tongues 22, 22 of the two elastic plates 12, 12, so as to close an eye 25 of the hook-shaped hook 4, while on the other hand, it permits the tongues 22 to be retracted, so as to open the eye 25, as shown in FIG. 2. When the slider tongues 22 are in their advanced position to close the eye 25 of the hook-shaped hook 4, a pointed end of the hook-shaped hook 4 or an utmost end 26 of a lip portion of the hook is positioned at a height h lower than upper edges 22*a* of the slider tongues 22. A top of bend in the hook-shaped hook 4 is positioned at a height H (from a bottom 27 of the needle body) at least equal to or higher than an upper edge 24*a* of the drop-stitch-preventing shoulder 24.

An outer edge of the hook-shaped hook 4, extending from the utmost end 26 of the lip portion of the hook to the top 28 of the bend of the hook-shaped hook 4 to form the eye 25 of the hook-shaped hook 4, is provided in the form of a stitch escape surface 29. The upper edge 24*a* of the drop-stitch-preventing shoulder 24, extending from a top of the drop-stitch-preventing shoulder 24 to the upper edge 22*a* of the slider tongue 22, is provided in the form of an inclined loop holding surface 30. An angle of inclination □1 of the stitch escape surface 29 is made smaller than an angle of inclination □2 of the inclined loop holding surface 30. The angle of inclination □1 is preferably set at an angle for stitches 31 to easily go beyond the stitch escape surface 29 of the hook so as to be knocked over. Preferably, the angle of inclination □1 is set at around 30°.

The inclined loop holding surface 30 is inclined at an adequate angel to a loop holding edge 32 of the each tongue 22, to prevent the stitches 31 held on the slider tongues 22 from slipping off the tongues 22. If the angle of inclination □2 is an excessive acute angle, the stitch drop preventing effects cannot be achieved. On the other hand, if the angle of inclinational is an obtuse angle, the release of the stitches from the tongues 22 is hindered. Therefore, the angle of inclination is adequately selected from therebetween. Now, suppose that when five stitches are held on the slider tongues 22, a yarn 33 for the next course is fed to the needle and the stitches are tried to be knocked over, as shown in FIG. 2. As shown in FIGS. 2A and 2B, when the yarn 33 for the next course is fed to the needle, the stitches 31 are held on the loop holding edges 32 of the slider tongues 22 in the condition of being prevented from rash action by the drop-stitch-preventing shoulder 24.

Thereafter, as shown in FIGS. 2C and 2D, the hook-shaped hook 4 is wedged between the two elastic plate members 12, 12 of the slider 2, so that the utmost end 26 of the lip portion of the hook is held in sandwich relation between the two slider tongues 22, 22. Then, when the utmost end 26 of the lip portion of the hook is further wedged into the slider, the stitches 31 held on the loop holding edges 32 and retained by the drop-stitch-preventing shoulder 24 are raised up by the stitch escape surface 29 of the hook-shaped hook 4. Then, the stitches are released from the drop-stitch-preventing shoulder 24, going beyond the top 28 of the bend of the hook of the hook-shaped hook 4 to be knocked over.

Figure 3:
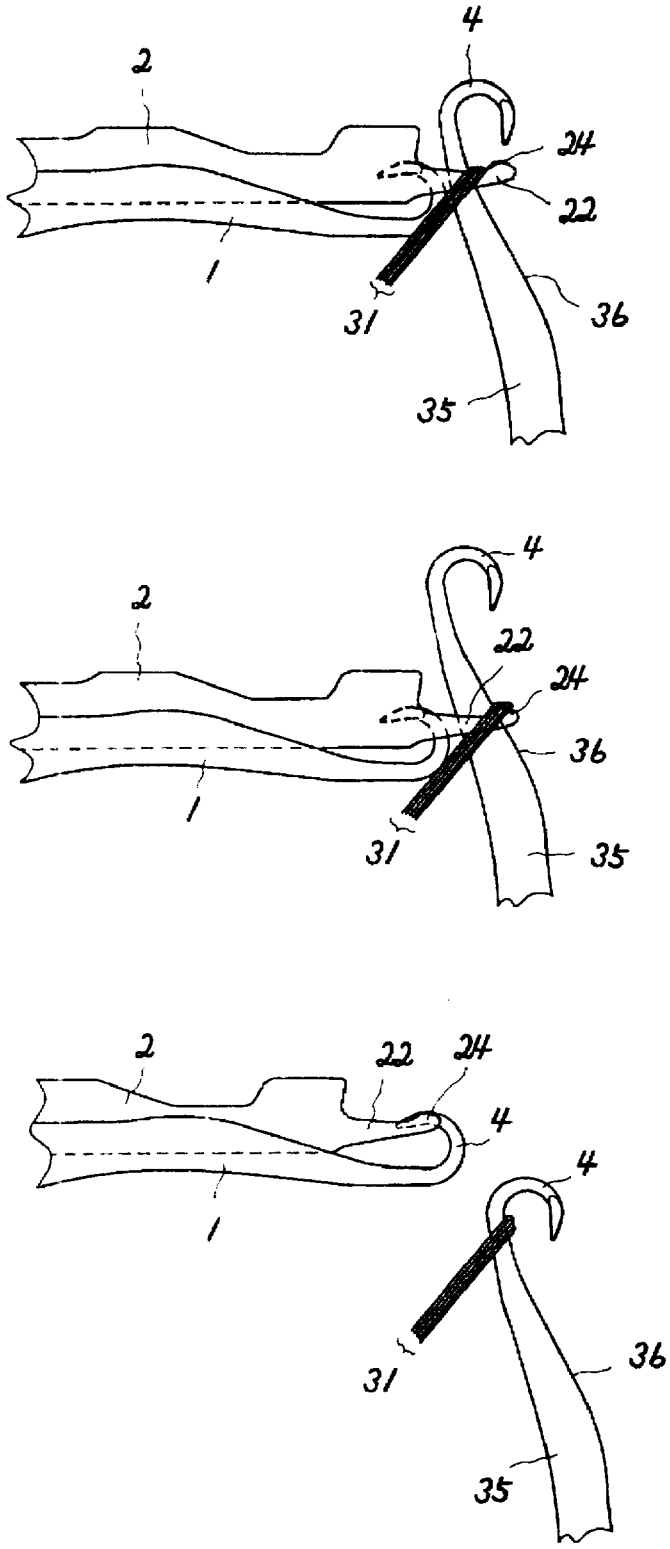
FIG. 3 is a diagram showing a variant of the compound needle.

While in the embodiment illustrated above, the drop-stitch-preventing shoulders 24 are designed to have the inclined loop holding surfaces, any alternatives to the inclined surfaces may be used, without limiting to the inclined surfaces, as long as they can prevent the stitches from accidentally slipping off the ends of the tongues and also can cooperate with the stitch escape surface to knock over the stitches. Also, while in the embodiment illustrated above, after raised up by the stitch escape surface of the hook-shaped hook, the stitches retained by the drop-stitch-preventing shoulder of the slider go beyond the top of the bend of the hook, while sliding over the outer edge of the hook, modifications may be made in the invention such as, for example, providing drop-stitch-preventing shoulders 35 having such a configuration as shown in FIG. 3 for the tongues 37, so that the stitch (not shown) is allowed to go beyond the drop-stitch-preventing shoulders 35 by the stitch escape surface 47 of the hook 45, first, and then is allowed to be guided again by gently inclined surfaces 41 formed on the tongues to be positioned at a higher level than the shoulder 35 of the tongues 37, so that the slider and the hook are cooperated with each other to make the stitches go beyond the hook 45, so as to knock over the stitches.

CAPABILITIES OF EXPLOITATION IN INDUSTRY

It is the objective of the present invention to provide a compound needle capable of preventing the loops held on the slider tongues from slipping off the tongues by the drop-stitch-preventing shoulders and also knocking over the loops held on the tongues without being affected by the drop-stitch-preventing shoulders.

What is claimed is:

1. A compound needle comprising a needle body having a hook-shaped hook at a front end thereof and a slider which is supported on the needle body to move relative thereto in a longitudinal direction of the needle body to the hook-shaped hook so as to open and close the hook-shaped hook, so as to capture a knitting yarn and escape a knitting stitch, wherein a tongue provided at a front end portion of the slider is provided, at a front end thereof, with a drop-stitch-preventing shoulder to prevent a stitch held on the tongue of the slider from slipping off the tongue during a knitting operation, and also the hook-shaped hook is provided, on an outer edge thereof extending from a front end of a lip portion thereof toward a top thereof, with a stitch escape surface, such that when the hook-shaped hook is closed by the tongue, the drop-stitch-preventing shoulder is hidden by the stitch escape surface to facilitate a knock-over of the stitch.

2. The compound needle according to claim 1, wherein the drop-stitch-preventing shoulder has an inclined loop holding surface, and the stitch escape surface provided on the hook has an angle of inclination smaller than that of the inclined loop holding surface.

3. The compound needle according to claim 1 or 2, wherein when the hook-shaped hook is closed by the tongue of the slider, a part of the stitch escape surface at the front end of the lip portion of the hook is positioned at a lower level than an upper edge of the drop-stitch-preventing shoulder at the front end of the tongue of the slider with respect to a height of the hook-shaped hook between a bottom of the needle body of the hook-shaped hook and the front end of the lip portion of the hook, so that the part of the stitch escape surface is hidden by the tongue of the slider.

4. The compound needle according to any one of claims 1 through 3, wherein the hook-shaped hook is so curved that when the hook-shaped hook is closed by the tongue of the slider, the stitch escape surface at a top of bend of the hook-shaped hook is positioned at a level at least equal to or higher than an upper edge of the drop-stitch-preventing shoulder at the front end of the tongue of the slider with respect to a height of the hook-shaped hook between a bottom of the needle body of the hook-shaped hook and the top of bend of the hook-shaped hook.

* * * * *